US005582080A

United States Patent [19]

Barmore

[11] Patent Number: 5,582,080

[45] Date of Patent: Dec. 10, 1996

[54] RATCHET WRENCH

[76] Inventor: Thomas C. Barmore, 4 N. 126 Verrill, Addison, Ill. 60101

[21] Appl. No.: 312,280

[22] Filed: Sep. 26, 1994

[51] Int. Cl.[6] ..... B25B 13/46

[52] U.S. Cl. ..... 81/63; 81/177.85

[58] Field of Search ..... 81/60–63.2, 177.85

[56] References Cited

U.S. PATENT DOCUMENTS

| | | | |
|---|---|---|---|
| 4,218,940 | 8/1980 | Main | 81/63 |
| 4,300,413 | 11/1981 | Garofalo | 81/62 |
| 4,445,404 | 5/1984 | Parker | 81/62 |
| 4,589,307 | 5/1986 | Parker | 81/62 |
| 4,848,196 | 7/1989 | Roberts | 81/177.85 |
| 5,000,066 | 3/1991 | Gentiluomo | 81/63 X |

*Primary Examiner*—D. S. Meislin

*Attorney, Agent, or Firm*—Paul H. Gallagher

[57] ABSTRACT

The wrench includes a body with a head and a radial handle. The handle includes a rear segment adjacent the head and an outer segment for gripping by the hand. Mounted in the head is a spindle for releasably holding a socket, and a ratchet pawl. A pair of links are mounted in the body of the handle, one for each the releasing function and actuating the ratchet pawl, extending through the rear position and having push-buttons exposed to the exterior at the juncture of the segments, for actuation by the same hand that holds the wrench.

18 Claims, 4 Drawing Sheets

Fig. 17
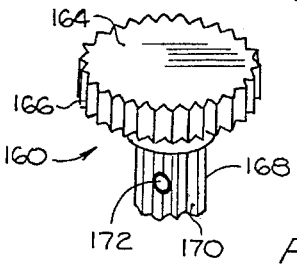
Fig. 18
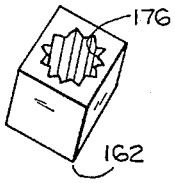
Fig. 19a
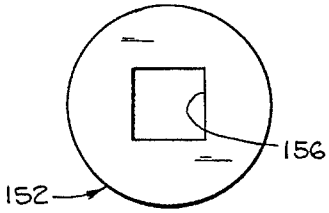
Fig. 24
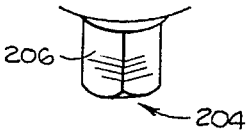
Fig. 25
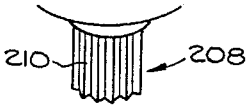
Fig. 19
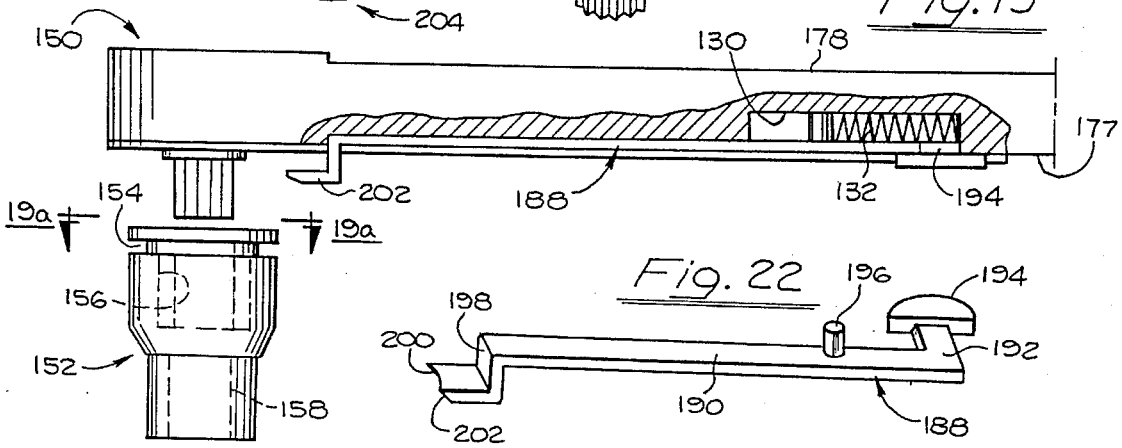
Fig. 22
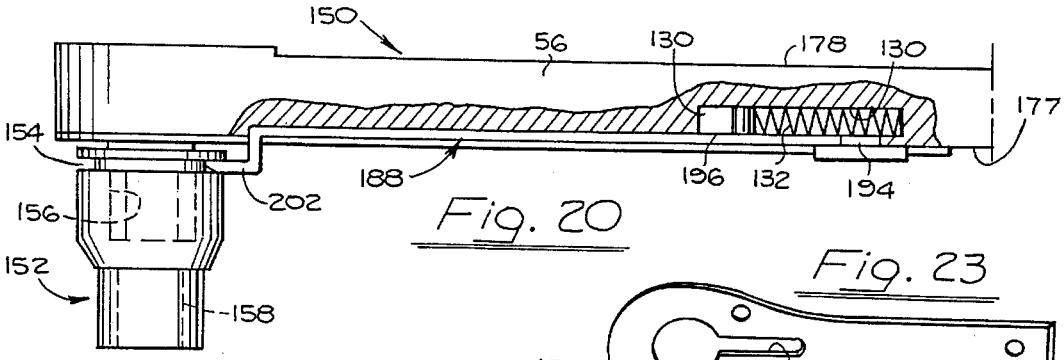
Fig. 20
Fig. 23
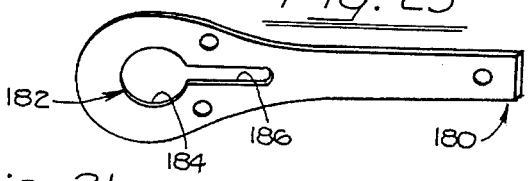
Fig. 21
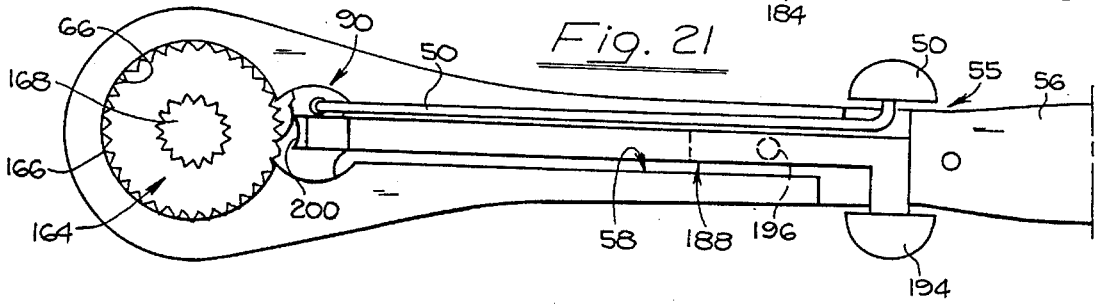

RATCHET WRENCH

FIELD OF THE INVENTION

The present invention resides in the field of what are generally known as ratchet wrenches. A ratchet wrench is a form of socket wrench, and includes ratchet mechanism enabling the wrench to be turned either way selectively, for turning the workpiece on which it is used, and the wrench to be retracted in the opposite direction without producing a turning force on the workpiece.

As used herein, ratchet wrench is intended to include socket wrenches generically.

A socket wrench is a wrench that is used with a plurality of sockets of different sizes, to accommodate different sizes of workpiece, in what is generally known as a ratchet wrench set, or socket wrench set. The sockets are selectively detachably mounted on the wrench, and each then removed for mounting of another socket. Heretofore it has been necessary for the user to use both hands to produce full and effective use of the wrench.

A main object of the present invention is to provide a ratchet wrench or socket wrench of the foregoing general character, which can be effectively used with only one hand. This feature provides two main advantages, it leaves one hand free for other manipulations, and it enables use of the wrench by a semi-incapacitated person, such as a person having only one good hand.

A ratchet wrench in addition to having the feature of interchangeability of sockets, also includes the feature of change in direction of ratcheting, for changing the direction of rotation of the driving element, selectively, in the same set of motions of the wrench, Heretofore it was necessary, from a practical standpoint, for the user to use his free hand for performing those manipulations, but in the present case those manipulations can be performed by the same hand holding the wrench.

As a matter of background, a ratchet wrench includes a head and a handle. The socket is mounted in the head, and the handle extends therefrom and is gripped at a position spaced from the head, for providing leverage. It is necessary to make the manipulations at the head for changing sockets, and changing the direction of ratcheting, and heretofore it was not practical for the user to use the same hand as that holding the wrench, for making those manipulations.

A main object of the invention is to provide a ratchet wrench having means that can be manipulated at the handle by the same hand holding the wrench, for effecting the manipulations referred to.

Another broad object is to provide a ratchet wrench of the character just identified, wherein the means for performing the manipulations mentioned, is of simple character, and can be easily incorporated in a socket wrench.

A further object is to provide such a wrench that includes novel construction, and adapters, to accommodate sockets of different kinds.

BRIEF DESCRIPTION OF THE INDIVIDUAL FIGURES OF THE DRAWINGS

Figure 14B:
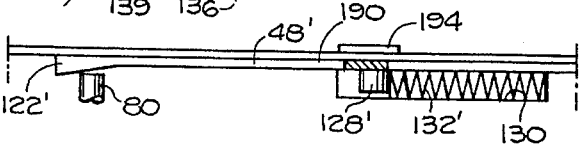
FIG. 14 is a longitudinal vertical sectional view, oriented according to FIG. 7, with the inner elements in place therein, omitting the hand grip segment of the wrench handle.
Figure 14:
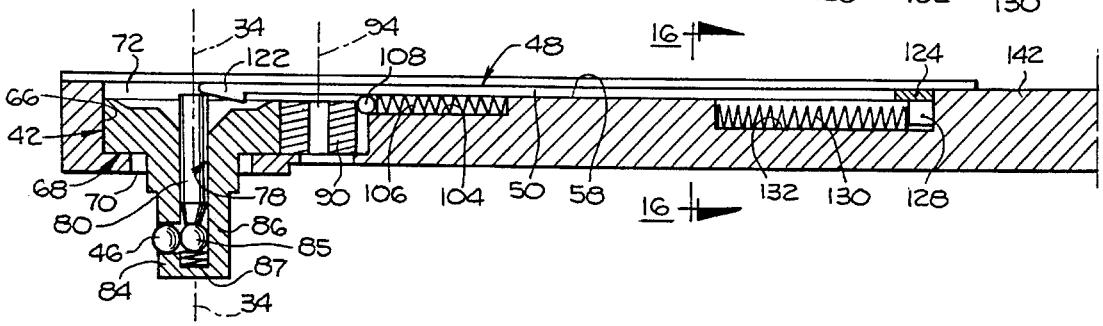

FIG. **14*a* is a fragmentary view of the left end portion of FIG. 14**, with certain elements in different positions.

FIG. **14*b*** illustrates an actuating link of an alternate form.

Figure 7:
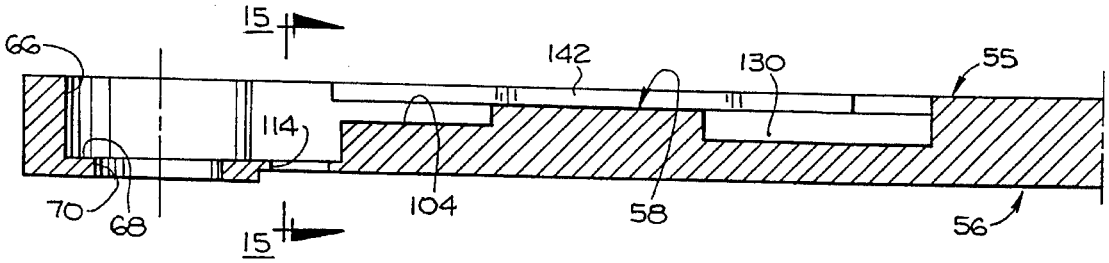
FIG. 7 is a longitudinal vertical sectional view of the body of the wrench with the cover and all the inner elements removed.
Figure 15:
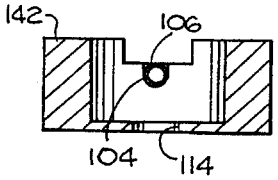

FIG. 15 is a sectional view taken at line 15—15 of FIG. 7.

Figure 16:
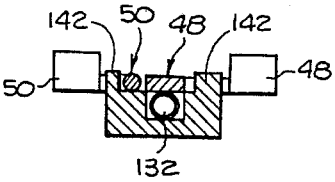

FIG. 16 is a sectional view taken at line 16—16 of FIG. 14.

FIGS. 17–23 show a second form of the device.

FIG. 17 shows the driving member of the second form.

FIG. 18 shows an adapter for the drive spindle and socket.

FIG. 19 is a view of the second form similar to FIG. 14 of the first form.

FIG. **19*a* is a view taken at line 19*a*–19*a* of FIG. 19**.

FIG. 20 is a view oriented according to FIG. 19, but with the socket mounted on the wrench.

Figure 4:
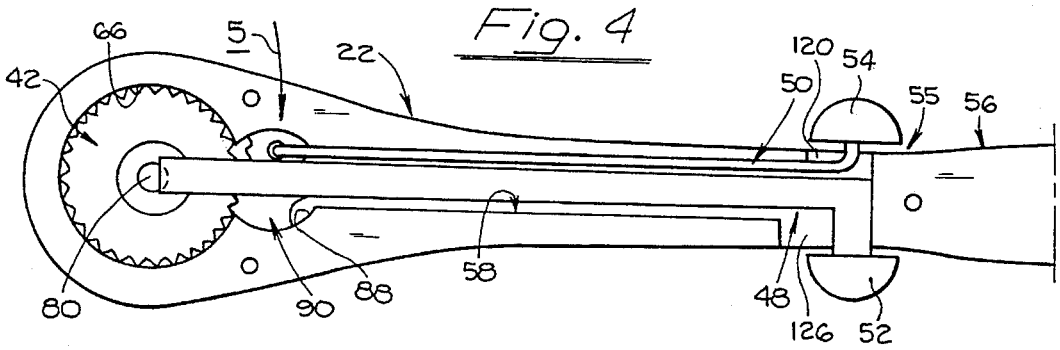
FIG. 4 is a face view of the wrench from the upper side, with the cover removed and showing the inner elements in the wrench.

FIG. 21 is a view of the second form similar to FIG. 4 of the first form.

FIG. 22 is a view of an actuating link of the second form.

FIG. 23 shows the wrench cover.

FIG. 24 is a fragmentary view of a modified form of drive spindle.

FIG. 25 is a fragmentary view of another modified form of drive spindle.

Figure 1:
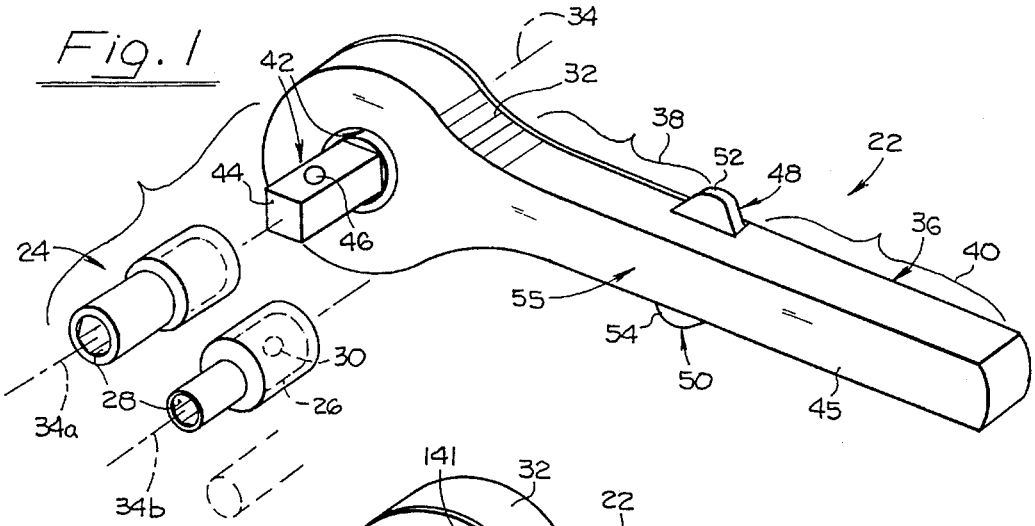
FIG. 1 is perspective of the wrench of the invention in association with sockets with which it is to be used, this figure showing the under side of the wrench.

Referring in detail to the drawings, FIG. 1 shows a ratchet wrench 22 and a plurality of sockets 24. Each socket includes a rear recess 26 and a front recess 28, together forming a hole through the socket. The rear recess is polygonal, usually square, for receiving the drive spindle of the wrench to be referred to again, provided with an undercut 30 for holding a detent in the drive spindle, for thereby releasably holding the socket. While in this case the recess and the drive spindle may be square, other shapes may be utilized such as splined or other geometric shape.

The front recess 28 is also non-circular, being toothed or polygonal, this recess receiving the workpiece to be turned. In the set of sockets, the front recesses 28 are of different sizes to correspond with different sizes of workpiece, but the rear recesses in all of the sockets are the same size for receiving the same driving element of the wrench. The front end of the socket may be of different outer diameters according to the sizes of those front recesses, the sockets being otherwise identical in shape and size. The sockets 24 here identified actually constitute socket members, but in the trade they are usually referred to as sockets and are so referred to herein.

The socket wrench includes a head 32 having a main axis 34, also referred to as an operational axis, about which the wrench is swung angularly. The sockets have longitudinal axes 34*a*, 34*b*, etc., which coincide with the main axis 34 when the sockets are mounted in the wrench.

The wrench includes a handle 36 extending radially from the head, the handle having an inner, near segment 38, and an outer, hand grip segment 40 at its extended end.

In the head is a driving member 42 (FIGS. 9, 14), mounted in the manner described hereinbelow, coaxial with the main axis 34. This driving member includes a drive spindle 44 in which is a detent ball 46 normally extending radially outwardly beyond the surface of the spindle, but yieldable inwardly, as described hereinbelow. This drive spindle extends axially through a first side 45 of the wrench, which in the first form of the device of FIGS. 1–16, is the under side, so designated according to the usual attitude of the wrench when in use.

Mounted in the head 32, as described hereinbelow, is the mechanism for manually controlling the placement of the socket on the driving spindle, and its release therefrom, and including ratcheting means. The means for manually controlling these two main steps are in the form of links identified 48 and 50 (FIG. 4), mostly entirely enclosed in the wrench and not visible in FIG. 1, but having push buttons or knobs 52, 54 extending to the exterior, at the juncture 55 of the segments 38, 40 of the handle. These knobs can be manipulated by the hand of the user which is holding the wrench, and specifically while gripping the hand grip segment 40.

Figure 8:
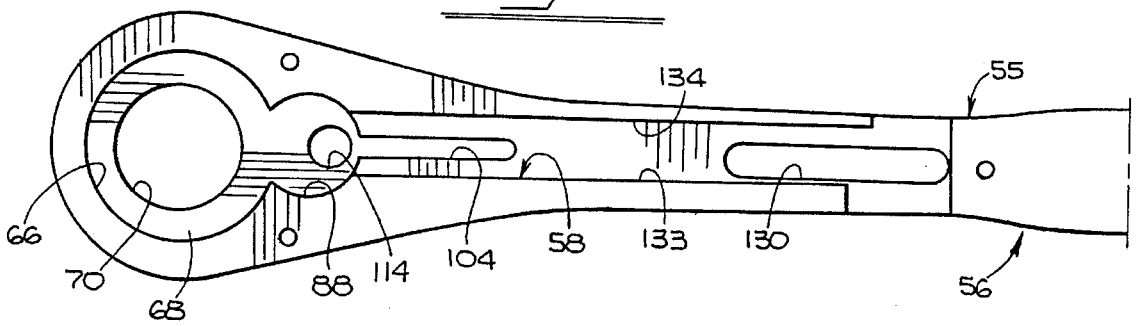
FIG. 8 is a view taken from the top of FIG. 7.
Figure 9:
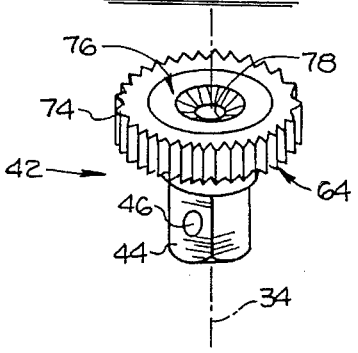
FIG. 9 is a perspective view of the driving element.
Figure 10:
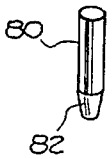
FIG. 10 is perspective view of a releasing pin used in the driving element of FIG. 9.
Figure 11:
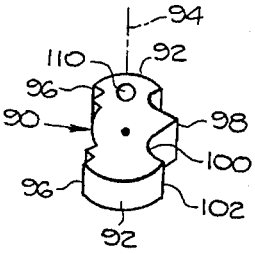
FIG. 11 is a perspective view of the ratcheting pawl.
Figure 12:
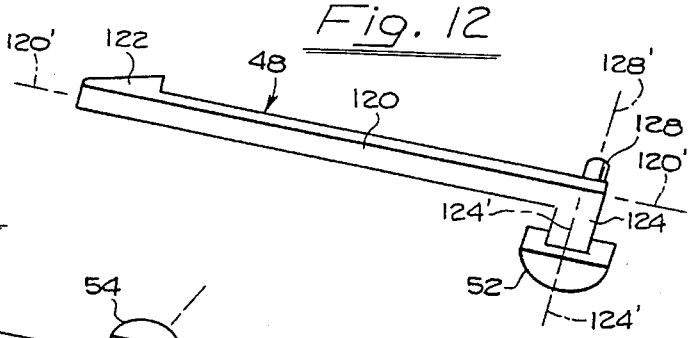
FIG. 12 is a perspective view of one of the manual control links.
Figure 13:
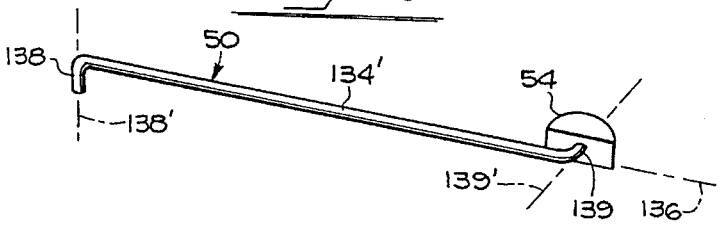
FIG. 13 is perspective view of another of the manual control links.

Referring particularly to FIGS. 7 and 8, the wrench includes a body 56 made up of a single integral piece, such as a forging. The body is provided with a large, elongated recess 58 extending longitudinally through the segment 38 of the handle and into the head 32. This recess is enclosed by a cover 60 (FIGS. 2, 3), and the movable control and operating parts and elements are mounted in this recess and held therein by the cover, as described in detail hereinbelow.

The driving member 42 (FIG. 9) is a one-piece, integral member and includes a ratchet gear 64 in addition to the drive spindle 44. The driving member is mounted in a cylindrical recess 66 having a smooth periphery, which is an element of the recess 58 and includes a bottom annular flange 68 (FIGS. 7, 8, 14) defining a smaller hole 70 through the bottom and through which the spindle extends. The recess element 66 opens through the upper surface of the body. The driving member is thus concentric with the main axis 34 of the wrench. The ratchet gear 64 is dimensioned so that the teeth 74 thereof engage the peripheral surface of the recess 66, being confined thereby, and it has an axial dimension or depth less than that of the recess element 66, and is butted on the flange 68 leaving a space 72 above the ratchet gear. This relationship will be referred to hereinbelow.

The upper surface of the ratchet gear 64 has an overall concave shape, through which an axial hole 78 extends, and which extends downwardly into the drive spindle 42. Attention is directed to FIG. 14 showing this portion of the construction. A releasing pin 80 (see also FIG. 10) is positioned in this hole, which has a tapered lower end 82. FIG. 14 also shows the detent ball 46 (see FIG. 1), positioned in a hole 84 in the drive spindle, being held therein by a constriction 83 at the outer end of the hole. A second or blocking ball 85 is positioned in the hole 78 between the detent ball 46 and the opposite wall element 86. A compression spring 87 is positioned under the blocking ball and biases it upwardly to a normal blocking position radially or transversely in line with the detent ball, and the various elements are dimensioned so that when the blocking ball is in that blocking position, it blocks the detent ball from moving radially inwardly, from its outer active position in which it holds the socket on the spindle. The pin 80 holds the blocking ball from moving upwardly out of blocking position, and when the pin is depressed it moves the blocking ball downwardly and enables the detent ball to move inwardly into the space provided by the taper 82. The pin, in turn, is held in place as described below.

Figure 14A:
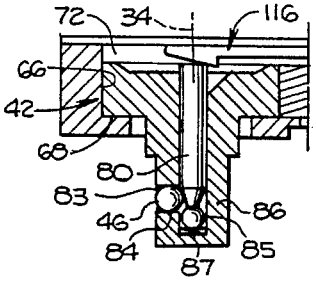

As referred to above, when a socket 24 is to be applied to the wrench, the drive spindle 44 is inserted into the recess 26 of the socket and the detent ball 46 (FIG. 14) enters into the undercut 30 in the socket, the detent ball normally holding the socket in place on the drive spindle, but when the pin is depressed (downwardly, FIG. 14, and see FIG. 14*a*) the ball is released, as noted above, and the socket drops off the drive spindle, upon the wrench being held in appropriate position.

The element 66 of the recess 58 leads into another recess element 88 (FIGS. 4, 8), in which a ratcheting pawl 90 (FIGS. 4–6, 11) is positioned in free floating manner, this pawl having an axial dimension, or depth, similar to that of the ratchet gear 64 and meshes therewith as referred to below. There is a space above the ratcheting pawl (FIG. 14), as in the case of the driving member 42, to accommodate control members as referred to again below.

The ratcheting pawl 90 has cylindrical surfaces 92 at opposed sides, these surfaces engaging the peripheral surface of the recess element 88 which confine it in position. Upon rocking movement as guided by these surfaces, it rocks about a central axis 94. It has ratcheting teeth 96 adjacent the respective side surfaces 92, alternately engageable with the teeth 74 of the ratchet gear 64, when it is moved or rocked to opposite positions as referred to below. At the side of the element 90, opposite the teeth 96, is a central cam 98. On opposite sides of this cam are arcuate concave shapes or depressions 100 terminating outwardly in points or teeth 102.

For yieldingly holding the ratcheting pawl 90 in the selected position, the wrench body is provided with a groove 104 in the floor of the main recess 58 in which is a compression spring 106, and a detent ball 108. The elements are so arranged that the detent ball fits into one of the arcuate shapes or depressions 100 and produces the rocking movements of the pawl. The pawl is so rocked by manual manipulation as referred to hereinbelow, for this purpose having an eccentrically positioned hole 110.

Figure 5:
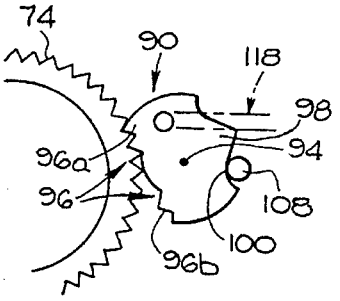
FIG. 5 is a fragmentary large scale view of certain elements located as indicated by the arrow 5 of FIG. 4.
Figure 6:
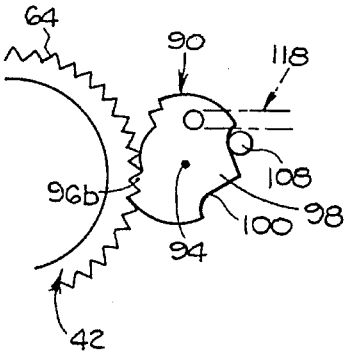
FIG. 6 is view similar to FIG. 5 but showing the ratcheting pawl in a different position.

Referring particularly to FIGS. 5 and 6, FIG. 5 shows the pawl 90 in a first position in which teeth 96*a* are in engagement with the teeth of the ratchet gear. In this position the detent ball 108 is in a corresponding depression 100, and when the pawl is rocked, the detent ball 108 rides over the central cam 98, the latter having opposite surfaces at such inclination as to enable this. The pawl is normally held in one position, and is rocked to the opposite position upon sufficient pressure being applied thereto. The outer points 102 are of such inclination and direction as to act as stops and prevent the ball from riding thereover, thereby holding the pawl in the position it then assumes. These figures show the opposite positions of the pawl which enables ratcheting action in corresponding directions. In ordinary use of the wrench in a ratcheting operation, the teeth 96 ride over the teeth on the ratchet gear, the pawl yields, and the detent ball 108 rides partially up on the side surfaces of the cam 98. In this action, the pawl works against the yieldable compression spring 106 which returns the ball to holding position.

In socket wrenches made heretofore, in the steps of changing sockets and changing the ratcheting direction, it was necessary for the user to use his other hand, i.e. the hand not holding the wrench. In the wrench of the present invention, these two steps can be performed by the same hand that is holding the wrench by the hand grip. The means for enabling these steps, includes manual control links 48, 50 identified above and shown in FIGS. 12 and 13. The control link 48 is for releasing the socket from the wrench and the link 50 for changing the direction of ratcheting.

Figure 2:
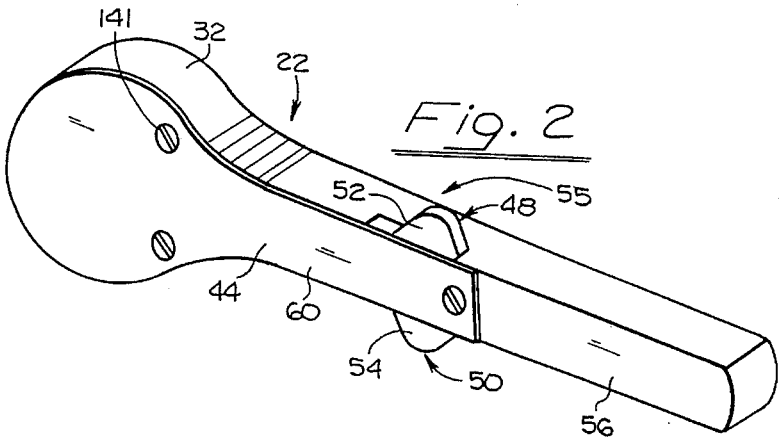
FIG. 2 is a perspective view of the wrench showing the upper side.

The link 48 includes an elongated flat shank 120 (see also FIG. 16), having a cam element 122 at an inner end, and a lateral projection 124 at the outer end, and on the latter is a push button 52 (FIGS. 1 and 2). This link is fitted in the elongated recess 58, resting on the floor thereof. The inner end is adjacent to or at the main axis 34 (FIG. 14) so that the cam 122 is engageable with the releasing pin 80 for actuating the latter, when so controlled. The lateral projection 124 extends out through a notch 126 in the side wall of the recess. At the outer end of the shank 120 is a stub pin 128 (FIGS. 12, 14) which fits in a longitudinal groove 130 in the floor of the main recess 58. The elements 120, 124, 128 are on mutually perpendicular axes 120', 124', 128'. A compression spring 132 (FIG. 14) is positioned in the groove, radially inwardly from the pin 128, which biases the link 48 outwardly, to the inactive position in which the cam 122 does not effectively engage the pin 80. When the link is advanced, in inward direction, the cam 122 engages the pin and depresses it and as referred to above, the blocking ball 85 (FIG. 14*a*) is depressed which releases the detent ball 46 from holding position.

The link 48 and its action may be reversed, as represented in FIG. 14*b*. In this figure, elements shown in FIG. 14 are also shown here, identified by the same reference numerals with prime indications. The link 48' is longer than in FIG. 14, and the cam 122' is reversed. The spring 132' is compressed between the outer end of the groove and the pin 128', the latter being spaced radially inwardly from the outer end of the link.

The recess 58 has side walls 133, 134 (FIG. 8) confining the links 48, 50 (FIGS. 4, 16), the side wall 133 serving to retain the link 48 in radial position relative to the main axis 34, and the link 50 is confined between the link 48 and the other side wall.

The link 50 (FIGS. 4, 13) includes a shank 134' having an elongated dimension as indicated by the axis 136. This link is placed in the main recess 58, as noted, beside the link 48 (FIGS. 4, 16). The inner end of the shank includes a downturned tip 138 (FIG. 13), directed according to the vertical axis 138'. This tip is fitted in the hole 110 in the ratcheting pawl 90 (FIGS. 4–6,) for rocking the pawl. At the outer end of the shank is a transversely turned tip 139 extending along the directional axis 139', and secured to the outer end of this pin is the pushbutton 54 (FIG. 1) referred to above. The elements 134, 138, 139 are mutually perpendicular.

Figure 3:
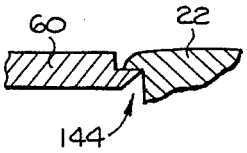
FIG. 3 is a fragmentary view of means for releasably holding the cover on the wrench.

The cover 60 (FIG. 2) is applied over the main recess 58 and secured as by screws 141, this cover holding the separate elements, identified above, in the recess. In an alternative arrangement, the cover may be hold by a snap engagement 144 (FIG. 3). Also to be noted, is that the cover holds down the inner end of the link 48 so that when the link is in retracted position, the pin 80 is held down and the blocking ball 85 is held against moving above blocking position.

The links 48, 50 constitute manual manipulating means, at one end operably engageable with the corresponding elements in the head, and at the other end exposed to the exterior. In the use of the wrench, the user grasps the hand grip segment 36, at the outer end of the handle, and the necessity for using his free hand for manipulating the release of the sockets, and changing the direction of ratcheting is eliminated.

In putting a socket onto the wrench, the user merely applies the head end of the wrench to the socket and pushes the pushbutton 48, and in association therewith, pushes the head of the wrench axially, and the socket is fitted thereon. To release the socket, he merely pushes the pushbutton and holds the wrench in appropriate direction, i.e. with the socket down. In response to actuating the link 48 inwardly, the cam 122 depresses the releasing pin 80, and the tapered lower end 82 of the pin enables the detent ball to recede radially inwardly, releasing the socket. The compression spring 132 normally retains the link 48 in retracted, inactive position.

The one-handed nature of the wrench is a great advantage in the case of a semi-incapacitated person, e.g. one who has the use of only one hand. In that case it would be indeed cumbersome and extremely time consuming in using wrenches heretofore known, in changing sockets, and changing the direction of ratcheting.

In the manipulation of the socket release in the use of the present device, the user need only push forward on the pushbutton and release the socket, and the link is returned by the compression spring 132.

In the case of changing the direction of ratcheting, the link 50 is not biased in either direction; the user pushes forward on the link in one case, and releases it, and the link and the ratcheting pawl remain in corresponding position; when it is desired to change it back in the other direction, the user pulls or withdraws the link in retracting direction and releases it, and the link remains in that position, and the ratcheting pawl in corresponding position, until deliberately moved again.

FIGS. 17–23 show a ratchet wrench with means for adapting it to sockets of a different kind, e.g. a socket having exterior conformation for gripping and holding the socket on the wrench. In association with the driving member of FIG. 17 attention is directed also to the modified forms of FIGS. 24 and 25 described below.

The wrench of this form utilizes the same body or main member 56 utilized in the first form, and shown in FIGS. 7 and 8. The wrench of the present form designated in its entirety at 150, and set up as described below, is for use with a socket 152 of known kind, having an exterior circumferential groove, or undercut, 154 adjacent its upper end, for releasably retaining the socket on the wrench. FIG. 19*a* shows the upper end of the socket, having a rear recess 156 which is polygonal in cross section, and which is usually square as shown here, for insertion of the drive spindle, and the socket has a front recess 158 for fitting on the workpiece. The wrench includes a driving member 160 (FIG. 17) and a special adapter 62 (FIG. 18) the former having a head 164 with a ratchet gear 166, and a reduced drive spindle 168. The driving member 160 is fitted in the head of the wrench body, with the ratchet gear 166 engaging the inner peripheral wall 66 (FIG. 21), and the drive spindle 168 extending to the exterior, in a manner described hereinbelow.

The drive spindle 168, in the present case, has splines 170, or other geometric or non-circular shape, and includes a detent ball 172 engageable with an undercut 176 in the adapter for holding the adapter on the spindle. The adapter serves as an insert to be placed in the socket recess, when the latter is of square shape. The adapter 162 is provided with a recess 176, having a peripheral surface of splined shape, to accommodate the splines 170 in the driving member, the adapter thus functioning to adapt the splined drive spindle 168 to the square recess 156 in the socket. The splines on the drive spindle are of angular spacing less than 90°, and actually considerably less than that, which enables the drive spindle to be inserted in the socket in successive instances without at any time requiring the wrench itself to be turned a full 90° relative to a previous position.

The wrench of the present form (FIGS. 17–23) is arranged for the drive spindle 168 to be extended to the exterior through the side opposite that of the first form, and thus in the present case the wrench when in its normal use in turning the workpiece has an underside 177 and an upper side 178. The under side in the present case corresponds with the side exposed in FIG. 4, i.e., with the recess 58 in view. In the present case the recess 58 opens downwardly, and is covered by a cover plate 180 (FIG. 23) which is the same in outline shape as the cover 60, but in addition includes a keyhole aperture 182 having a circular element 184 and a slot 186. It is held in place by suitable means, such as screws as in the case of FIG. 2, or the snap feature 144 of FIG. 3. The cover normally holds the elements 160, 90, 188, 50 as well as the spring and detent balls in place, but is omitted from FIGS. 19, 20, 21 for convenience.

The wrench of the present form includes a link or manual control element 188 similar to the link 48, and including an elongated shank 190 having a transverse projection 192 at its outer end on which is a pushbutton 194. A stub or stem 196 is located on the shank 190, spaced from the outer end of the latter. At its inner end, the link has a lug 198 terminating in an end edge 200 of circular concave shape to engage the socket evenly.

This link 188 is fitted in the main recess 58, flat on the bottom of the recess, with the pushbutton 194 extending out through the side edge of the recess to the exterior. The stem 196 fits in the groove 130, and the compression spring 132 is compressed between the stem and the outer end edge of the groove, biasing the link radially inwardly.

When the link is so fitted in the recess 58, the lug 198 extends downwardly through the slot 186 in the cover, and the edge 200 extends into the groove 154 and acts as a locking element for holding the socket in place.

In conjunction with fitting the link 190 in the recess, the driving member 160 is fitted in the recess 66, with the drive spindle 168 extending downwardly through the hole 184 to the exterior. After the socket is put on the drive spindle, as referred to above, the compression spring 132 biases the link radially inwardly, holding the link in locking position. The locking edge 200 has a camming element 202 enabling the lug to snap over the upper edge of the socket and into the groove.

The two forms of the ratchet wrenches herein disclosed accommodate sockets held in place (a) by gripping their interior elements, as in the first form, and (b) gripping the exterior gripping elements as in the second form.

FIGS. 24 and 25 show fragmentarily forms of driving member, similar to FIG. 17 but without means for holding the socket. FIG. 24 shows a driving member 204 with a square drive spindle 206, and FIG. 25 a driving member 208 with a splined drive spindle 210. Both of these drive spindles are without detent elements such as the ball 172 (FIG. 17) and in each case the driving member is integral, solid and whole, and without any moving elements. The drive spindles fit in the sockets of corresponding shapes, and the sockets are not held on the spindles by interacting elements between the spindles and the sockets, but only by the external elements on the sockets and the element 200.

I claim:

1. A ratchet wrench for use with a socket, the socket being releasably mounted on the wrench, comprising, the wrench including a head having a main operational axis, and a handle extending radially from the head, the handle having an inner, near segment adjacent the head and an outer, hand grip segment at its extended end, the segments being secured together at a juncture to form the handle, the wrench being operable in an angular swinging movement about said axis, the wrench having a latching means in the head movable between a latching position and a releasing position for correspondingly latching a socket on the head, and releasing it therefrom, the handle being of such great length that a normal user, while grasping the outer segment in the hand, cannot extend the thumb or any of the fingers of that hand to reach the head, and the head includes a cylindrical recess element, and the wrench includes a ratchet member in the recess element having a ratchet gear in the recess element and a drive spindle extending axially to the exterior of the wrench, the drive spindle includes a detent for releasably latching a socket on the spindle, and having an axial hole, a releasing pin is loosely fitted in the axial hole and is operable for effecting movement of the detent, and the detent in the drive spindle extends to a limited extent radially outwardly beyond the side wall of the drive spindle for engagement with a depression in the socket, the drive spindle includes a blocking element for retaining the detent in an outward holding position, and the releasing pin is engageable with the blocking element for moving it out of retaining position, and has a tapered lower end enabling radially inward releasing movement of the detent, the detent and blocking element are balls, and the blocking element is operable when the balls are on a common radius, spring means biases the blocking element upwardly to retaining position, the releasing pin retains the blocking element from moving upwardly from retaining position, the wrench including a movable actuating link with an element adjacent to and operably engageable with the latching means with a manually operable pushbutton adjacent to the juncture of said segments of the handle workable by the thumb of the hand grasping the hand grip segment, for moving the actuating link.

2. A ratchet wrench according to claim 1 wherein, the wrench has an upper surface and a recess opening through that surface, said recess including said cylindrical recess element, the wrench includes a detachable cover closing the recess, the cover is operable for limiting upward movement of the releasing pin for holding it in retaining position, the wrench includes ratcheting means in the recess, the actuating link is in the recess, the wrench includes biasing means and a detent ball in the recess operable for yieldably moving the actuating link and ratcheting means in predetermined directions, and the cover is also operable for retaining the actuating link and the biasing means and the detent ball in the recess.

3. A ratchet wrench for use with a socket, the socket being releasably mounted on the wrench, comprising, the wrench including a head having a main operational axis, and a handle extending radially from the head, the handle having an inner, near segment adjacent the head and an outer, hand grip segment at its extended end, the segments being secured together at a juncture to form the handle, the wrench being operable in an angular swinging movement about said axis, the wrench having a rotatable driving member including a drive spindle for mounting a socket thereon and consequently rotating the socket, the wrench having latching means movable between a latching position and a releasing position for correspondingly latching a socket on the drive spindle, and releasing it therefrom, the wrench also having ratcheting means for selectively alternatively rotating the drive spindle in opposite directions, the handle being of such great length that a normal user, while grasping the outer segment in the hand, cannot extend the thumb or any of the fingers of that hand to reach the head, the wrench including a pair of movable actuating links with inner ends operably engaging respectively the latching means and the ratcheting means, and extending radially outwardly, with manually actuatable pushbuttons on their outer ends located adjacent to the juncture of said segments of the handle, workable by the thumb of the hand grasping the hand grip segment.

4. A ratchet wrench according to claim 3 wherein, the wrench and the socket have interengaging elements releasably holding the socket on the wrench, and those holding elements on the socket are on the exterior of the socket.

5. A ratchet wrench according to claim 4 wherein, the holding elements on the wrench including at least an element on one of said actuating links exterior to the main part of the wrench engageable with holding elements on the exterior of the socket.

6. A ratchet wrench according to claim 5 wherein, the wrench includes a body having a closed side and an open side, the body has an elongated main recess opening to the exterior through the open side, said one of said actuating links is positioned mainly in the main recess but with a lug extending through the main recess to the exterior for engaging the holding elements on the socket.

7. A ratchet wrench according to claim 6 wherein, the actuating links includes a latching link and a ratcheting link, both links have pushbuttons extending to the exterior at a mid-point of the handle, and the ratcheting link is otherwise positioned entirely in the interior of the handle.

8. A ratchet wrench according to claim 6 wherein, the means for latching the socket on the wrench includes a drive spindle extending through the open side of the wrench to the exterior, the socket is mounted on the drive spindle and thereby extends from the open side.

9. A ratchet wrench according to claim 3, in combination with, an adapter, the latching means including a drive spindle extending to the exterior, the drive spindle having splines spaced apart at less than 90°, the adapter having a polygonal exterior surface for engaging in a corresponding recess in a socket, and a recess having splines corresponding to the splines on the drive spindle for receiving the latter.

10. A ratchet wrench according to claim 3 wherein, the driving member is mounted axially in the head and has a ratchet gear in the head, the driving member being of integral structure, and the wrench having means other than the driving member for detachably mounting the socket on the drive spindle.

11. A ratchet wrench according to claim 10 in combination with, an adapter having inner and outer surfaces of different character for adapting the drive spindle to the drive recess of a socket in combinations in which the drive spindle and recess are of corresponding different character.

12. A ratchet wrench according to claim 3 including, a body including the head and the handle, and having at least one recess with ratcheting means in the head and the actuating links in the handle, the driving member having a drive spindle on which the sockets are directly mounted, and the driving member, the ratcheting means, and the actuating links, all being contained in said recess except the drive spindle and the pushbuttons which are exposed to the exterior of the wrench.

13. A ratchet wrench according to claim 12 and including, means entirely contained in said recess operable for yieldingly moving the latching link radially outwardly to releasing position, and means entirely contained in said recess operable for yieldingly retaining the ratcheting means in either of opposite selected operating positions.

14. A ratchet wrench according to claim 12 wherein, the body is of integral, one-piece construction, the wrench has an upper side and an under side, said recess, throughout its extent, opens through the upper side, and the recess is covered by a single flat cover plate.

15. A ratchet wrench according to claim 14 wherein, said recess is a single recess, and the actuating links are positioned in the single recess, and in side-by-side relation throughout the range of their common longitudinal extent.

16. A ratchet wrench according to claim 14 wherein, the driving member includes an axially slidable pin having an upper end exposed in said recess, the pin being operable in latching and releasing a socket, one of said actuating links being in the form of a flat blade with a flat cam element engaging the upper end of said pin, and being operable on sliding movement thereof for moving the pin downwardly, and said one of said actuating links engaging said cover plate and the cover plate limiting the upward movement of the link and pin.

17. A ratchet wrench according to claim 16 wherein, the drive spindle includes a detent ball movable radially between an outer latching positions and an inner releasing position, a blocking ball having an upper blocking position in which it holds the detent ball in latching position, and a lower releasing position, means yieldingly biasing the blocking ball upwardly, and said pin being operable, on downward movement thereof, for moving the blocking ball downwardly to releasing position.

18. A ratchet wrench for use with a socket, the socket being releasably mounted on the wrench, comprising, the wrench being elongated, having a head at one end and a hand grip segment at the other end, the wrench including a rotatable driving member and latching means adjacent the head for latching the socket on the driving member, the wrench also including ratcheting means in the head, and the wrench also including links for operating the latching means and ratcheting means respectively, and having pushbuttons adjacent said hand grip segment on opposite sides of the wrench both actuatable by the thumb of the hand holding the wrench, said links extending from said hand grip segment to the head where they have inner ends directly manipulating said latching means and said ratcheting means.

* * * * *